United States Patent [19]

Fabrig

[11] 4,426,871

[45] Jan. 24, 1984

[54] APPARATUS FOR PRODUCING HELICAL WIRE COILS

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 321,809

[22] Filed: Nov. 16, 1981

[30] Foreign Application Priority Data

Nov. 15, 1980 [DE] Fed. Rep. of Germany ..... 3043171

[51] Int. Cl.[3] ..... B21F 3/04

[52] U.S. Cl. ..... 72/141; 72/142; 72/145

[58] Field of Search ..... 72/135, 141, 142, 145; 140/92.3, 92.4, 92.94, 92.2; 242/7.17, 125.1

[56] References Cited

U.S. PATENT DOCUMENTS

| | | | |
|---|---|---|---|
| 190,139 | 5/1877 | Hoffman | 72/145 X |
| 3,159,188 | 12/1964 | Da Costa et al. | 140/92.2 |
| 3,378,045 | 4/1968 | Thurman | 140/92.2 |
| 3,520,334 | 7/1970 | Mueller | 140/92.94 |

FOREIGN PATENT DOCUMENTS

| | | | |
|---|---|---|---|
| 83079 | 10/1895 | Fed. Rep. of Germany | 72/135 |
| 2234633 | 1/1974 | Fed. Rep. of Germany . | |
| 2043720 | 10/1980 | United Kingdom | 140/92.2 |

*Primary Examiner*—E. Michael Combs

*Attorney, Agent, or Firm*—Kontler, Grimes & Battersby

[57] ABSTRACT

Apparatus for producing a helical wire coil which can be subdivided into discrete spiral binders for use in steno pads or other types of stationery products has a driven mandrel with a cylindrical intermediate section flanked by two frustoconical sections whose larger-diameter ends are adjacent to the respective axial ends of the cylindrical section. The wire to be coiled is fed into the inlet of a helical path which is defined by guide pins distributed around the sections of the mandrel. The inlet is adjacent to one of the frustoconical sections and the wire which is fed into the inlet advances along the helical path to be coiled during travel around the one frustoconical section, thereupon around the cylindrical section and finally around the other frustoconical section. The exposed surface of the cylindrical section may be grooved. The distance between the inlet of the helical path and the cylindrical section is less than the length of the cylindrical section, as considered in the axial direction of the mandrel. The other frustoconical section ensures that the convolutions of the coil can contract subsequent to advancement beyond the cylindrical section but remain coaxial with the mandrel.

10 Claims, 4 Drawing Figures

APPARATUS FOR PRODUCING HELICAL WIRE COILS

BACKGROUND OF THE INVENTION

The present invention relates to apparatus for producing helical coils of metallic wire, plastic wire or the like. More particularly, the invention relates to improvements in apparatus for producing helical wire coils which can be subdivided (for example, immediately downstream of the location of making) into discrete spiral binders of the type normally used to hold together the sheets of a steno pad, exercise book, album or an analogous stationery product by extending through perforations provided in one marginal portion of a stack of superimposed sheets consisting of paper, foil, cardboard and/or the like.

Apparatus of the above outlined character normally employ a coiling tool in the form of a driven mandrel having a conical external surface adjacent to stationary guide means which define a helical path for a length of wire that is supplied or steered into the inlet of such path by a preferably adjustable feeding device. The lead of the helical path which is defined by the guide means corresponds to or approximates the desired lead of the wire coil, and the wire advances in a direction from the smaller-diameter end toward the larger-diameter end of the mandrel. Since the guide means is stationary, it pushes successively formed convolutions axially of the rotating mandrel, i.e., toward and beyond the larger-diameter end of the conical peripheral surface.

Apparatus of the above outlined type are disclosed in a large number of patents and other printed publications. Reference may be had to German Pat. Nos. 337,096, 362,058 and 1,944,371. German Offenlegungsschriften Nos. 2,234,633 and 2,835,511 as well as U.S. Pat. Nos. 3,101,750, 3,378,045, 3,520,334 and 3,568,728. All of these apparatus share the feature that the mandrel has an elongated conical peripheral surface, i.e., that the entire coiling station is adjacent to a surface diverging in the direction of axial movement of the developing coil. The helical path along which the wire advances in the region of the conical external surface of the mandrel is defined by stationary guide means in the form of a sleeve having a helical internal groove or in the form of several rows of pin-shaped guide elements which are staggered with reference to each other to define a helical path of desired lead. It is also known to employ guide means in the form of or including ball bearings. As the wire advances along the helical path, it is expanded by the conical surface of the rotating mandrel and thus undergoes permanent deformation as a result of stretching action upon the material of the wire. In order to reduce friction between the expanding wire and the surface of the mandrel, the apparatus normally comprises means for spraying boring liquid or another suitable lubricant onto the external surface of the wire in a region immediately upstream of the locus of initial contact between successive increments of the wire and the conical surface of the mandrel. It has been found that such lubrication is of little help or to no avail at all because the friction-induced heat is often so pronounced that the lubricant evaporates on contact with the conical surface. Frictional engagement between the wire and the mandrel then entails a deterioration of the external surface of the coiled product.

Another drawback of presently known apparatus is that the convolutions of the freshly finished coil do not remain in axial alignment with the mandrel. In other words, the axes of those convolutions which advance beyond the larger-diameter end of the mandrel are likely to be inclined with reference to the axis of the mandrel so that it is difficult to properly guide the coil in a machine which forms spiral binders and threads the binders into the perforations of successively supplied stacks of paper sheets or the like. The absence of axial alignment between the mandrel and the convolutions which have advanced beyond the larger-diameter end of the mandrel is attributable to the tendency of such convolutions to contract as soon as they leave the conical surface. The inclination of that portion of the coil which has advanced beyond the mandrel with reference to the axis of the mandrel depends on the lead of the coil, i.e., it varies from one type of coil to another type so that it is necessary to carry out prolonged adjustments whenever the apparatus is converted from the making of one type of coil to the production of a different type of coils. As a rule, accurate adjustment (e.g., so that the coil can be threaded into the rows of perforations in successive stacks or piles of sheets) is achieved only after several attempts, i.e., each adjustment takes up a substantial amount of time and must be carried out by skilled, experienced and careful attendants.

OBJECTS AND SUMMARY OF THE INVENTION

An object of the invention is to provide an apparatus which can form a helical wire coil with minimal or relatively low friction between the wire and the coiling tool.

Another object of the invention is to provide an apparatus of the just outlined character which does not distort or cause distortion of the freshly formed coil.

A further object of the invention is to provide a novel and improved coiling tool for use in the above outlined apparatus.

An additional object of the invention is to provide an apparatus which can be rapidly converted for the making of different types of helical wire coils and wherein such conversion does not affect the direction in which the finished coil advances beyond the coiling tool.

Still another object of the invention is to provide an apparatus of the above outlined character which can be installed in existing spiral binder making and inserting machines as a superior substitute for heretofore known helical wire coil forming or winding apparatus.

A further object of the invention is to provide a relatively simple and inexpensive wire coil forming apparatus which invariably ensures that the coil which advances beyond the coiling tool remains in a position of axial alignment with the tool.

An additional object of the invention is to provide the apparatus with novel and improved means for maintaining the freshly formed coil in axial alignment with the coiling tool.

A further object of the invention is to provide the apparatus with novel and improved means for permitting controlled contraction of those convolutions of the coil which advance beyond the coiling tool.

An ancillary object of the invention is to provide an apparatus which is not likely to damage the surface of the wire during coiling and which generates less friction heat than heretofore known coil winding apparatus.

The invention resides in the provision of an apparatus which serves to produce a helical wire coil, especially a helical wire coil which can be subdivided into so-called spiral binders of the type normally used to hold together the sheets of a steno pad, exercise book or an analogous stationery product by extending through perforations which are provided along one edge of a stack of overlapping paper sheets or the like. The apparatus comprises a rotary mandrel having a substantially frustoconical section and a substantially cylindrical section adjacent to the larger-diameter end of the frustoconical section, a driven shaft or other suitable means for rotating the mandrel (such shaft can be coupled to the smaller-diameter end of the frustoconical section of the mandrel), stationary guide means adjacent to the periphery of the mandrel and defining a helical path whose lead at least approximates the desired lead of the helical wire coil and whose inlet is adjacent to (e.g., an intermediate portion of) the periphery of the frustoconical section, and means for feeding a length of wire into the inlet so that the wire advances along the helical path and is convoluted first around the frustoconical section and thereupon around the cylindrical section of the mandrel. The distance between the inlet of the helical path and the cylindrical section, as considered in the axial direction of the mandrel, is preferably less than the length of the cylindrical section. In fact, at least in many instances, the overall axial length of the frustoconical section can be less than the axial length of the cylindrical section.

The cylindrical section is preferably formed with an uneven (e.g., roughened) external surface. For example, such surface can be formed with a plurality of elongated grooves or flutes extending at least substantially in parallelism with the axis of the mandrel.

The mandrel can further comprise a conical (e.g., frustoconical) third section having a larger-diameter end adjacent to the cylindrical section (i.e., the latter is disposed between the frustoconical section and the third section of the mandrel). Such third section guides the convolutions of the wire coil downstream of the cylindrical section to thus even more reliably ensure that the coil remains coaxial with the mandrel.

The apparatus preferably further comprises a housing for the drive means and means (e.g., one or more ball bearings) for rotatably journalling the drive means and/or the mandrel in the housing in the region of the smaller-diameter end of the frustoconical section.

The guide means can comprise several rows of guide elements which extend substantially radially of the sections of the mandrel. For example, the guide means can comprise several sets of discrete rotary or non-rotatable guide elements and a common holder for each set. Such holders can be mounted on the aforementioned housing for the drive means which transmits torque to the mandrel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
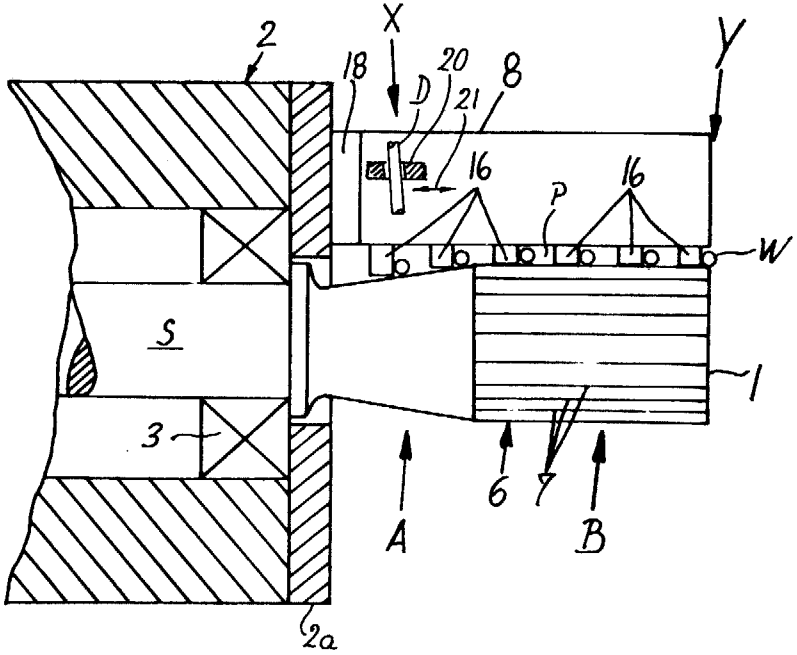
FIG. 2 is substantially axial sectional view as seen in the direction of arrows from the line II—II of FIG. 1.
Figure 1:
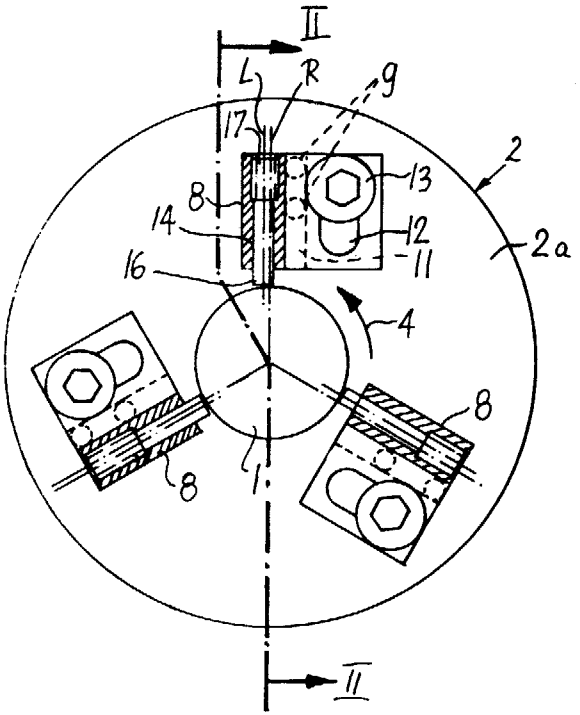
FIG. 1 is a partly end elevational and partly transverse sectional view of an apparatus which embodies one form of the invention.

Referring first to FIGS. 1 and 2, there is shown an apparatus which converts a continuous length of blank wire D into a helical wire coil W. The apparatus comprises a rotary coiling tool 1 in the form of a mandrel having a frustoconical section A and a cylindrical section B. The larger-diameter end of the frustoconical section A is adjacent to the respective end of the cylindrical section B, and the smaller-diameter end of the section A is adjacent to and coupled or made integral with a drive means here shown as a motor-driven shaft S installed in a stationary cylindrical housing 2. The shaft S and/or the respective end of the frustoconical mandrel section A is journalled in several antifriction bearings 3, e.g., in ball bearings of which only one is shown in FIG. 2. The direction in which the shaft S is driven when the motor (not shown) is on is indicated by the arrow 4.

The front end portion of the housing 2 is constituted by a washer-like plate 2*a* which carries three equidistant holders 8 for sets or rows of discrete guide elements in the form of rotary guide pins or studs 16. The guide pins 16 are adjacent to and extend substantially radially of the mandrel 1 to define a helical path P whose lead equals or approximates the desired lead of the helical wire coil W. The path P has an inlet X where the wire D is fed thereinto by a supplying device 20 which is preferably adjustable in directions indicated by arrow 21 to thereby vary the lead angle of the wire. The axial length of that portion of the frustoconical section A which extends between the inlet X and the adjacent end of the cylindrical section B is less than the length of the section B. In fact, the length of the entire section A need not exceed and can be less (see FIG. 2) than the length of the section B.

The peripheral surface 6 of the cylindrical section B is roughened (i.e., its non-skidding properties are enhanced) by the provision of elongated flutes or grooves 7 which extend in parallelism with the axis of the mandrel 1.

The three holders 8 are preferably identical as to their dimensions and also as concerns the distribution of their guide pins 16. The aforementioned helical path P is defined by the three sets of pins 16 because two of the holders 8 are secured to the plate 2*a* of the housing 2 by interposition of distancing elements 18 having different thicknesses (only one such distancing element can be seen in FIG. 2). Owing to the placing of distancing elements 18 between the plate 2*a* and two of the three holders 8, the three sets of guide pins 16 are disposed at different distances from the outer side of the plate 2*a*, i.e., they are staggered with reference to each other, as considered in the axial direction of the sections A and B.

Each of the holders 8 is adjustable with reference to the housing 2, as considered in the radial direction of the mandrel 1. To this end, the plate 2*a* of the housing 2 carries two posts 9 for each of the three holders 8, i.e., a total of six posts 9, and the exposed portions of such posts (whose inner portions can extend into tapped bores of the plate 2a) extend into grooves 11 which are machined into the concealed surfaces of the respective holders 8, i.e., into those surfaces which are adjacent to the plate 2a or to the respective distancing elements 18. The posts 9 cooperate with the surfaces surrounding the corresponding grooves 11 to guide the respective holders 8 during adjustment with reference to the mandrel 1. When a holder 8 assumes the desired position, it is fixed to the plate 2a by a bolt 13 whose shank extends through an elongated slot 12 of the respective holder. The slots 12 are parallel with the adjacent grooves 11.

Each holder 8 is formed with six bores 14 for an equal number of guide pins 16. The guide pins 16 are partially confined in the respective bores 14 and are held in selected axial positions by locking screws 17 extending into the outer portions of the bores 14 and meshing with the corresponding holders 8. Each guide pin 16 is rotatable in the respective bore 14, and its inner end portion extends toward the exposed surface of the section A or B of the mandrel 1. The operator can change the extent to which the inner end portions of the pins 16 project beyond the respective holes 14 by rotating the associated screws 17.

As mentioned above, the dimensions of the distancing elements 18 are selected with a view to ensure that the lead of the path P equals or approximates the desired lead of the coil W. FIG. 1 shows that the axes L of the guide pins 16 are slightly offset with reference to the positions in which they would extend exactly radially of the mandrel 1 i.e., in which the axis L shown in FIG. 1 would coincide with the radius R; the extent of such offset equals of approximates the radius of a pin 16.

The operation:

The means which feeds wire D to the supplying device 20 is not specifically shown in the drawing. The device 20 supplies successive increments of the wire D into the inlet X of the path P, and such wire advances along the path P to form a series of convolutions surrounding first the frustoconical section A and thereupon the cylindrical section B on their way toward and beyond the discharge end Y of the path P. The pins 16 rotate as a result of engagement with the advancing convolutions of the wire D. The wire is stretched during travel around the surface of the frustoconical section A so that it undergoes permanent deformation and its convolutions remain unchanged during travel along the surface 6 of the cylindrical section B. The latter ensures the establishment of desirable force-locking engagement between the wire D and the mandrel 1. When a convolution advances all the way to the discharge end Y, it is free to slip with reference to the mandrel 1 and to contract thereafter. This ensures that the coil W which advances beyond the cylindrical section B remains coaxial with the mandrel 1.

An important advantage of the improved apparatus is that the mandrel 1 is not conical or frustoconical from the one to the other of its ends, i.e., that the wire D does not travel along a conical surface all the way from the inlet X to the discharge end Y of the helical path P. It has been found that, quite surprisingly, the improved apparatus can produce a coil W whose convolutions have a predictable size and shape in spite of the fact that the convolutions which surround the mandrel 1 advance first along a conical and thereupon a cylindrical surface. The conicity of the section A is or can be more pronounced than the conicity of conventional mandrels which are conical all the way between the inlet and the discharge end of the helical path; however, the conical section A can be relatively short, e.g., it can be surrounded by no more than two or three convolutions of the wire D which advances from the inlet X toward the left-hand axial end of the section B, as viewed in FIG. 2. This is desirable and advantageous because the stretching of wire D is completed rapidly with attendant reduction of the likelihood of damage to the surface of the wire during conversion into a succession of helical convolutions. The frictional engagement between the roughened surface 6 of the section B and the convolutions of the coil W is advisable and advantageous because this ensures that the material of the coil is properly advanced along the helical path P. Moreover, and as already pointed out above, the cylindrical section B ensures that the axis of that portion of the coil W which advances beyond the discharge end Y remains coaxial with the mandrel 1. This facilitates the threading of the leader of the coil W into a row of perforations in a stack of paper sheets or the like. Reference may be had to commonly owned U.S. Pat. Nos. 4,157,821, 4,161,196, 4,165,766 and 4,232,858 which disclose apparatus for making spiral binder note books or the like.

As mentioned above, a relatively short frustoconical section (or a relatively short distance between the inlet X and the adjacent end of the cylindrical section B), whose axial length is or can be less than that of the section B, reduces the likelihood of damage to the surface of the wire D during conversion into convolutions of the coil W. The grooves 7 in the surface 6 of the section B not only enhance the force-locking engagement between the mandrel 1 and the convolutions of the coil W but they also reduce the likelihood of damage to the surface of the wire during travel axially of the section B. Once a convolution has advanced onto the surface 6 of the section B, it moves only axially of the mandrel 1, i.e., in the longitudinal direction of the grooves 7; this explains why the section B does not cause any or any pronounced defacing of or other damage to the surfaces of convolutions which advance along the surface 6 from the section A toward the discharge end Y. Since the force-locking engagement between the grooved surface 6 of the section B and the convolutions of the coil W is highly satisfactory, the section B can be short which is desirable on the ground that the overall axial length of the mandrel 1 can be kept to a minimum with the result that the wire D is subjected to a less pronounced heating action.

Figure 3:
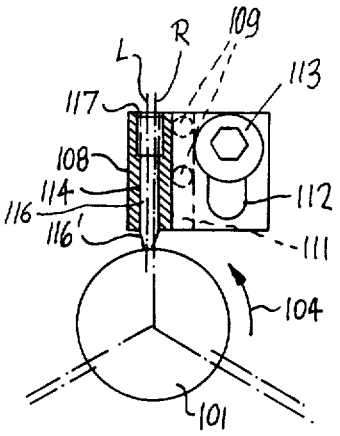
FIG. 3 is a fragmentary partly end elevational and partly transverse sectional view of a second apparatus.

FIG. 3 shows a portion of a modified apparatus wherein all such parts which are identical with or clearly analogous to the corresponding parts of the apparatus of FIGS. 1-2 are denoted by similar reference characters plus 100. The only difference between the two apparatus is that the guide pins 116 have frustoconical exposed portions 116' which are adjacent to the periphery of the mandrel 101. Such configuration of the tips 116' of pins 116 contributes to more satisfactory advancement of coiled wire toward the discharge end of the path which is defined by the three rows of pins 116.

Figure 4:
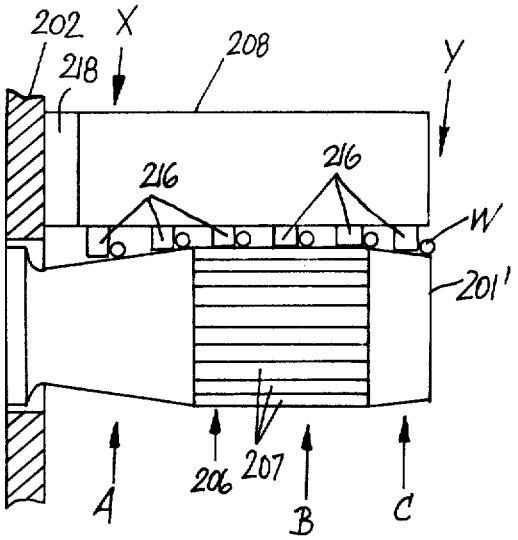
FIG. 4 is a fragmentary substantially axial sectional view of a third apparatus.

FIG. 4 shows a portion of a third apparatus wherein all such parts which are identical with or clearly analogous to the corresponding parts of the apparatus shown in FIGS. 1-2 are denoted by similar reference characters plus 200. The mandrel 201' of FIG. 4 comprises a third secton C which has a conical or frustoconical external surface and whose larger-diameter end is adjacent to the respective end of the cylindrical section B. In the embodiment of FIG. 4, the section B is disposed between and is thus flanked by two frustoconical sections, namely, by the relatively long section A and the relatively short section C. The purpose of the section C is to ensure even more reliable and even more predictable advancement of the unsupported coil W in a predetermined direction, namely, in such a way that the coil W which has advanced beyond the free (smaller-diameter) end of the section C remains coaxial with the mandrel 201'. The tendency of convolutions which advance beyond the cylindrical section B to move out of axial alignment with the mandrel is attributable to a certain amount of contraction of windings which move beyond the section B. Such windings are guided by the frustoconical third section C so that the latter ensures that the coil W remains coaxial with the mandrel 201', not only during contact with the peripheral surface of the mandrel but also after having advanced beyond the section C. The cylindrical section B greatly reduces the likelihood of movement of unsupported convolutions of the wire W out of axial alignment with the mandrel, but such likelihood is reduced even further by the simple expedient of placing the cylindrical section B between two frustoconical sections A, C whose larger-diameter ends are adjacent to the respective ends of the cylindrical section. The section C guides the convolutions subsequent to slight contraction which takes place when a convolution advances beyond the right-hand end of the section B, as viewed in FIG. 2 or 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehendedd within the meaning and range of equivalence of the appended claims.

I claim:

1. Apparatus for producing a helical wire coil, particularly a coil which is to be subdivided into spiral binders, comprising a rotary mandrel having a substantially frustoconical section and a substantially cylindrical section, said frustoconical section having a larger-diameter end adjacent to and a smaller-diameter end remote from said cylindrical section; means for rotating said mandrel; stationary guide means adjacent to said mandrel and defining a helical path whose lead at least approximates the desired lead of the coil, said path extending around said sections and having an inlet in the region of said frustoconical section so that successive increments of the wire first contact said frustoconical section; and means for supplying a length of wire into said inlet so that the wire advances along said path and is convoluted first around said frustoconical section and thereupon around said cylindrical section.

2. The apparatus of claim 1, wherein the distance between said inlet and said cylindrical section, as considered in the axial direction of said mandrel, is less than the length of said cylindrical section.

3. The apparatus of claim 1, wherein the length of said frustoconical section, as considered in the axial direction of said mandrel, is less than the length of said cylindrical section.

4. The apparatus of claim 1, wherein said cylindrical section has an uneven external surface to thus enhance friction between the wire and the cylindrical section.

5. The apparatus of claim 1, wherein said cylindrical section has an external surface provided with elongated grooves extending in substantial parallelism with the axis of said mandrel.

6. The apparatus of claim 1, wherein said mandrel further comprises a substantially conical third section having a larger-diameter end adjacent to said cylindrical section, said cylindrical section being disposed between said frustoconical section and said third section.

7. The apparatus of claim 6, wherein said third section is the frustum of a cone.

8. The apparatus of claim 1, wherein said guide means comprises several rows of guide elements extending substantially radially of said sections.

9. The apparatus of claim 1, further comprising a housing for said drive means and means for rotatably journalling said mandrel in said housing in the region of said frustoconical section.

10. The apparatus of claim 1, wherein said guide means comprises several sets of discrete guide elements and a common holder for each of said sets.

* * * * *